US007167072B2

(12) United States Patent
Hung et al.

(10) Patent No.: US 7,167,072 B2
(45) Date of Patent: Jan. 23, 2007

(54) METHOD OF FABRICATING INDUCTOR AND STRUCTURE FORMED THEREFROM

(75) Inventors: Chien-Chou Hung, Huatan Township, Changhua County (TW); Hua-Chou Tseng, Hsinchu (TW); Tsun-Lai Hsu, Hsinchu Hsien (TW); Cheng-Wen Fan, Hsinchu Hsien (TW); Chia-Hung Chin, Taipei (TW); Ellis Lin, Taipei (TW)

(73) Assignee: United Microelectronics Corp., Hsinchu (TW)

( * ) Notice: Subject to any disclaimer, the term of this patent is extended or adjusted under 35 U.S.C. 154(b) by 160 days.

(21) Appl. No.: 10/810,435

(22) Filed: Mar. 25, 2004

(65) Prior Publication Data

US 2005/0212641 A1 Sep. 29, 2005

(51) Int. Cl.
*H01F 5/00* (2006.01)
*H01F 27/28* (2006.01)

(52) U.S. Cl. ..... 336/200; 336/223; 336/232; 29/602.1

(58) Field of Classification Search ..... 336/200, 336/223, 232; 29/605–609, 602.1; 438/706, 438/720, 723–724

See application file for complete search history.

(56) References Cited

U.S. PATENT DOCUMENTS

| | | | | |
|---|---|---|---|---|
| 6,395,637 | B1 * | 5/2002 | Park et al. | 438/706 |
| 6,486,765 | B1 * | 11/2002 | Katayanagi | 336/182 |
| 6,650,220 | B1 * | 11/2003 | Sia et al. | 336/200 |
| 6,894,598 | B1 * | 5/2005 | Heima | 336/200 |
| 2003/0146816 | A1 * | 8/2003 | Furumiya et al. | 336/200 |

* cited by examiner

*Primary Examiner*—Anh Mai
(74) *Attorney, Agent, or Firm*—J.C. Patents

(57) ABSTRACT

An inductor formed on a substrate having a dielectric layer thereon is disclosed. The inductor includes a first inductor pattern, a second inductor pattern a third inductor pattern. The first inductor pattern is formed within the dielectric layer, the second inductor pattern is formed on the first inductor pattern and electrically connected thereto, and the third inductor pattern is formed on the second inductor pattern and electrically connected thereto, wherein the first inductor pattern, the second inductor pattern, and the third inductor pattern have similar pattern. Because the thickness of the inductor can be increased by forming a multi-layer inductor structure, the resistance of the inductor, therefore, is reduced.

23 Claims, 10 Drawing Sheets

METHOD OF FABRICATING INDUCTOR AND STRUCTURE FORMED THEREFROM

BACKGROUND OF THE INVENTION

1. Field of the Invention

The present invention relates to a method of fabricating a semiconductor device and a structure formed therefrom, and more particularly to a method of fabricating an inductor and a structure formed therefrom.

2. Description of the Related Art

In integrated circuits, inductors are very important devices. The inductors are usually circular or rectangular spiral metal wires and widely used in different applications. For high-frequency devices, they require high performance of inductors which means that they have high quality factors. For example, in wireless communication, the quality factor (Q) of inductors should have about 60. The definition of quality factor is represented by the following formula:

$$Q=\omega_0 L/R \quad (1)$$

Wherein $\omega_0$ is the resonant angular frequency of the inductor, R is the resistance of the inductor and L is the inductance of the inductor.

From formula (a), when L is fixed, quality value will increase with respect to the increase of the resonant angular frequency or the decrease of the resistance, wherein the resistance is proportional to the square of the current density. Therefore, one method of enhancing the quality factor is to increase the cross-sectional area of the metal wires for reducing the current density therein. The method can reduce the resistance of the metal wires and increase the quality factor.

Therefore, in semiconductor devices the high quality factor can be achieved by increasing the width of the metal lines. However, if the width of the metal lines is too large, charges will accumulate at the corners of the metal lines and the current density therefore cannot be reduced. Accordingly, the quality factor of the inductor cannot be enhanced. Therefore, the quality factor generated from the prior art semiconductor process is about 10.

In addition, most of the inductors are formed under the protection layer of a chip and near to the substrate, usually smaller than 10 μm. Therefore, in the application of the high-frequency devices the substrate becomes a conductor and consumes most of energy. Accordingly, the performance of the inductors deteriorates.

Although prior art proposed a three-dimensional structure comprising metal lines, vias and metal lines, the inductor is still too close to the substrate. Moreover, because of the process restriction, the via pattern cannot be formed as that of the metal lines and just forms a plurality of plugs between the metal lines. Therefore, the quality factor can be improved. Accordingly, lots of attention is paid in improving the quality factor and performance of inductors.

SUMMARY OF THE INVENTION

Therefore, an object of the present invention is to provide a method of fabricating an inductor which reduces the resistance of the inductor and improves the quality factor thereof without additional processes.

Another object of the present invention is to provide an inductor which is more distant from a substrate for reducing the interference resulting therefrom and improving efficacy of the chip.

The other object of the present invention is to provide an inductor having a multi-layer structure and a uniform thickness for enhancing the quality factor thereof.

The present invention discloses a method of fabricating an inductor formed on a substrate having at least one first dielectric layer thereon, the method comprising: forming a patterned first metal layer and a first inductor pattern within the first dielectric layer; forming a patterned second dielectric layer on the first dielectric layer for covering the first metal layer, the first inductor pattern and the first dielectric layer, the second dielectric layer having pluralities of first openings and second openings, wherein the first openings expose the first metal layer and the second openings expose the first inductor pattern; filling a metal within the first openings and the second openings for forming a second metal layer within the first openings and a second inductor pattern within the second openings, wherein the second metal layer electrically connects with the first metal layer and the second inductor pattern electrically connects with the first inductor pattern; and forming a patterned third metal layer on the second metal layer and a third inductor pattern on the second inductor pattern, wherein the third metal layer electrically connects with the second metal layer, the third inductor pattern electrically connects with the second inductor pattern, and the first inductor pattern, the second inductor pattern is similar to the third inductor pattern.

From the method described above, the present invention uses the multi-layer inductor pattern structure for increasing the thickness of the inductor. Therefore, the resistance of the inductor is reduced and the quality factor is increased. Moreover, the present invention is simply to fabricate the inductor without additional processes.

The present invention discloses an inductor having at least one planarized dielectric layer thereon, which comprises: a first inductor pattern, a second inductor pattern and a third inductor pattern, wherein the first inductor pattern is formed within the dielectric layer, the second inductor pattern is formed on the first inductor pattern and electrically connecting therewith and the third inductor pattern is formed on the second inductor pattern and electrically connecting therewith. The first inductor pattern, the second inductor pattern is similar to the third inductor pattern.

From the method and the structure described above, the first inductor pattern, the second inductor pattern and the third inductor pattern are simultaneously from with the upmost metal layer, metal plugs and metal pads, respectively.

In the method and the structure described above, the first inductor pattern, the second inductor pattern and the third inductor pattern constitute a three-dimensional inductor structure. As to a symmetric inductor, the inductor has an overlapping area. In order to avoid shortage within the inductor, the first inductor pattern does not connect with the third inductor pattern via the second inductor pattern at the overlapping area.

The present invention also discloses another method of fabricating an inductor formed on a substrate having at least one first dielectric layer thereon, the method comprising: forming a patterned first metal layer and a first inductor pattern within the first dielectric layer; forming a patterned second dielectric layer on the first dielectric layer for covering the first metal layer, the first inductor pattern and the first dielectric layer, the second dielectric layer having pluralities of first openings and second openings, wherein the first openings expose the first metal layer and the second openings expose the first inductor pattern; and forming a second metal layer filling the first openings and on the second dielectric layer and forming a second inductor pattern filling the second openings and on the second dielectric layer, wherein the second metal layer electrically connects with the first metal layer and the second inductor pattern electrically connects with the first inductor pattern.

From the method described above, the first inductor pattern, the second inductor pattern and the third inductor pattern are simultaneously formed with the upmost metal layer, metal plugs and metal pads, respectively. The metal plugs and metal pads are formed by the same deposition, lithography and etching processes.

In the method described above, the first inductor pattern and the second inductor pattern constitute a three-dimensional inductor structure. As to a symmetric inductor, the inductor has an overlapping area. In order to avoid shortage within the inductor, the first inductor pattern does not connect with the second inductor pattern at the overlapping area.

From the method and the structure described above, the present invention uses a multi-layer inductor pattern structure to increase the thickness of the metal wire, to reduce the resistance of the inductor, to enhance the quality factor and to improve the quality of the inductor.

In addition, each layer of the multi-layer inductor pattern structure of the present invention has similar pattern; therefore, the inductor has a uniform thickness and enhances the quality factor.

Additionally, the inductor and the metals pads can be formed together, which is more distant from the substrate than the prior art inductor; therefore, the interference resulting from the substrate to the inductor can be reduced and the chip performance is improved.

Moreover, the process is simplified because the metal plugs and metal pads are formed by the same deposition, lithography and etching processes.

Furthermore, because the inductors with respect to the metal plugs and metal pads have the same material, the contact resistance resulting from application of different materials can be avoided and the quality factor of the inductor is improved.

In order to make the aforementioned and other objects, features and advantages of the present invention understandable, preferred embodiments accompanied with figures are described in detail below.

DESCRIPTION OF SOME EMBODIMENTS

Figure 1:
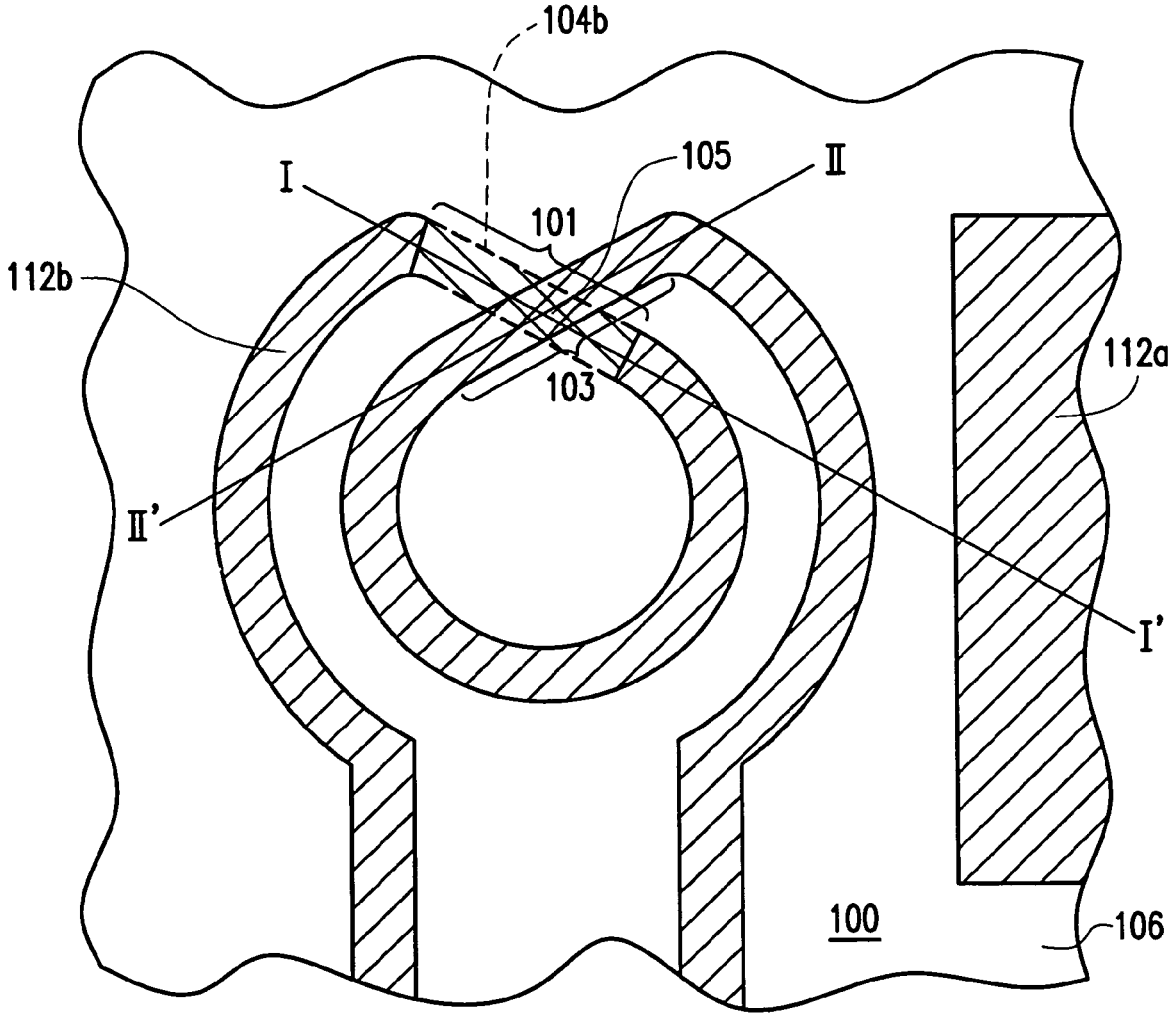
FIG. 1 is a schematic top view showing a first exemplary inductor of the present invention.
Figure 2A:
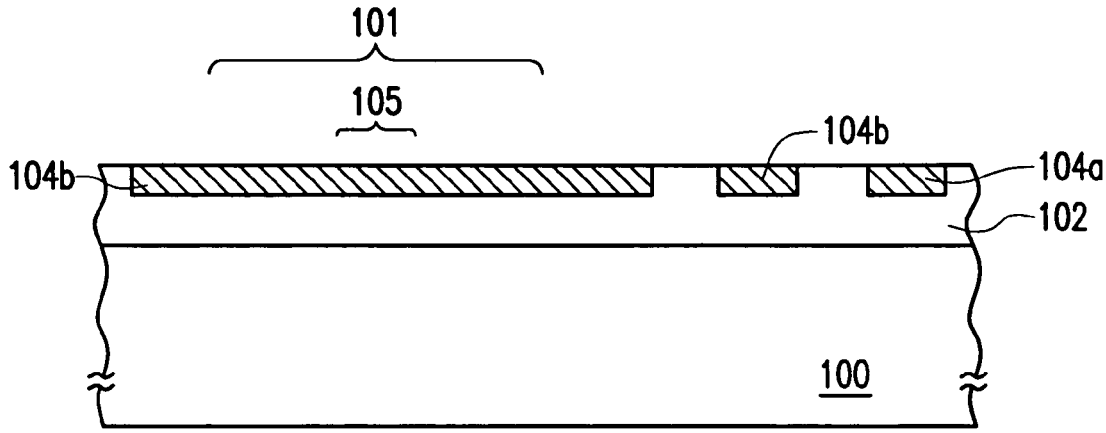
FIGS. 2A–2C are schematic cross-sectional views showing the structure along I–I' of FIG. 1.
Figure 2B:
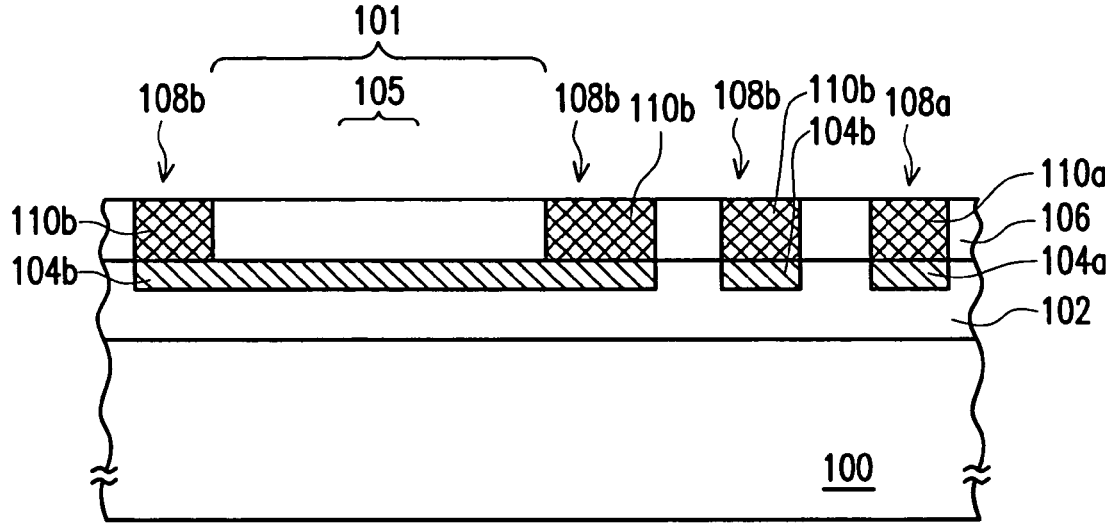
Figure 2C:
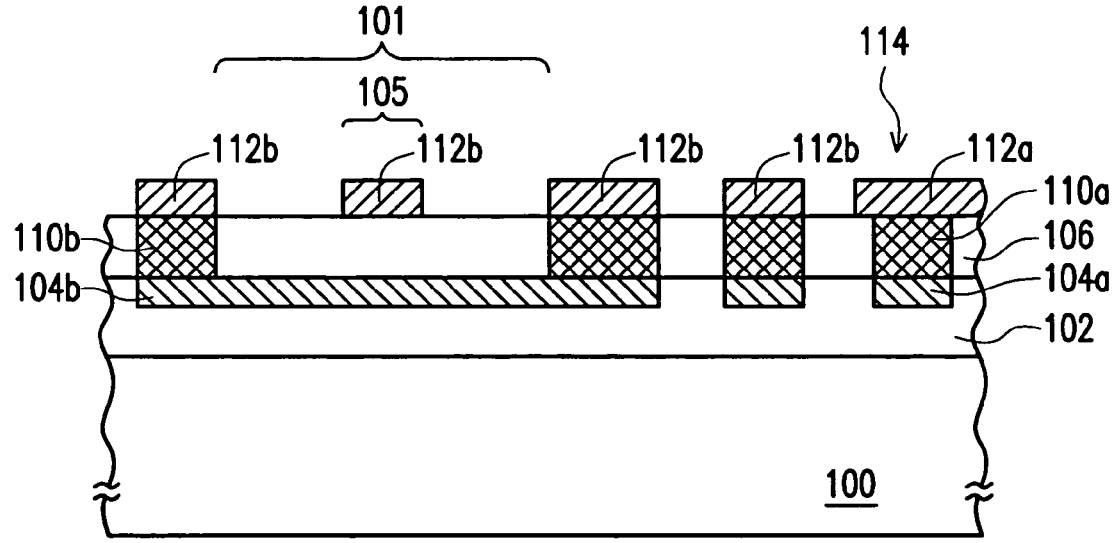
Figure 3A:
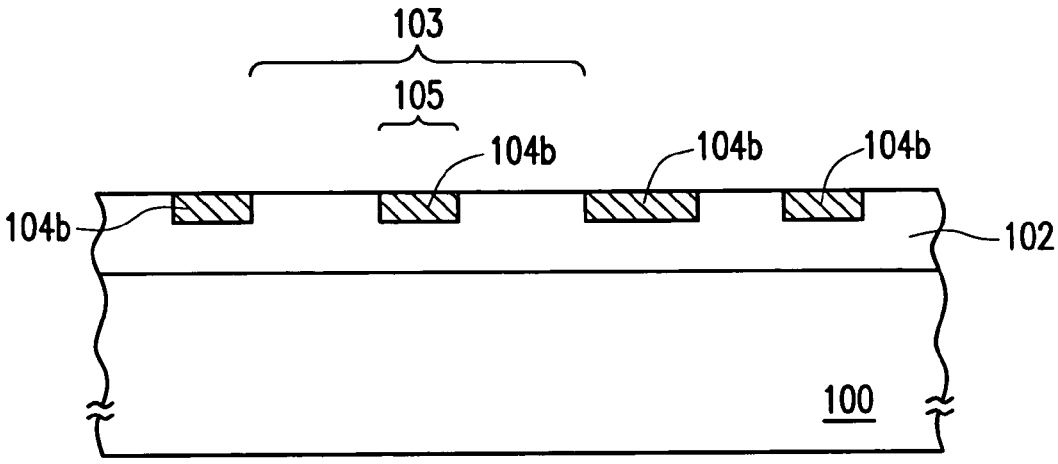
FIGS. 3A–3C are schematic cross-sectional views showing the structure along II–II' of FIG. 1.
Figure 3B:
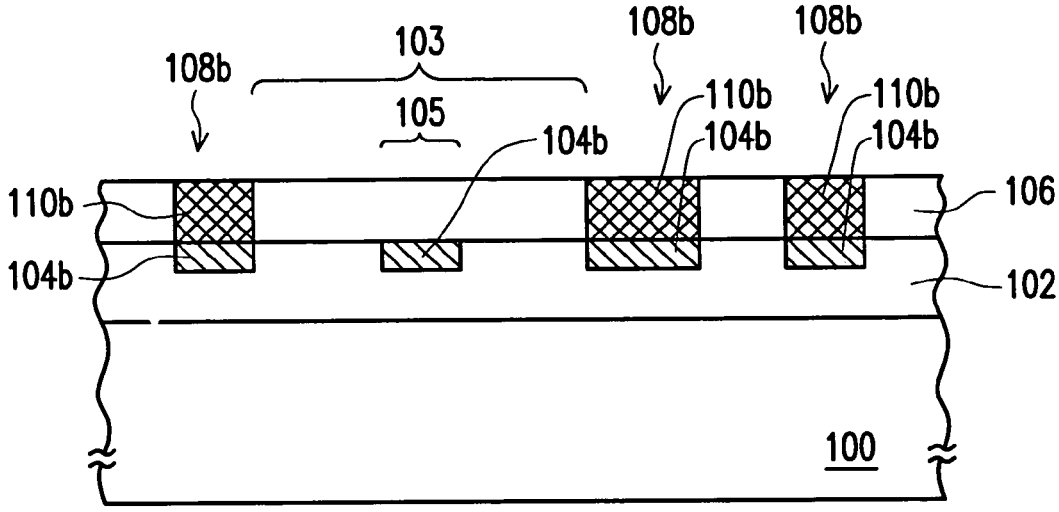
Figure 3C:
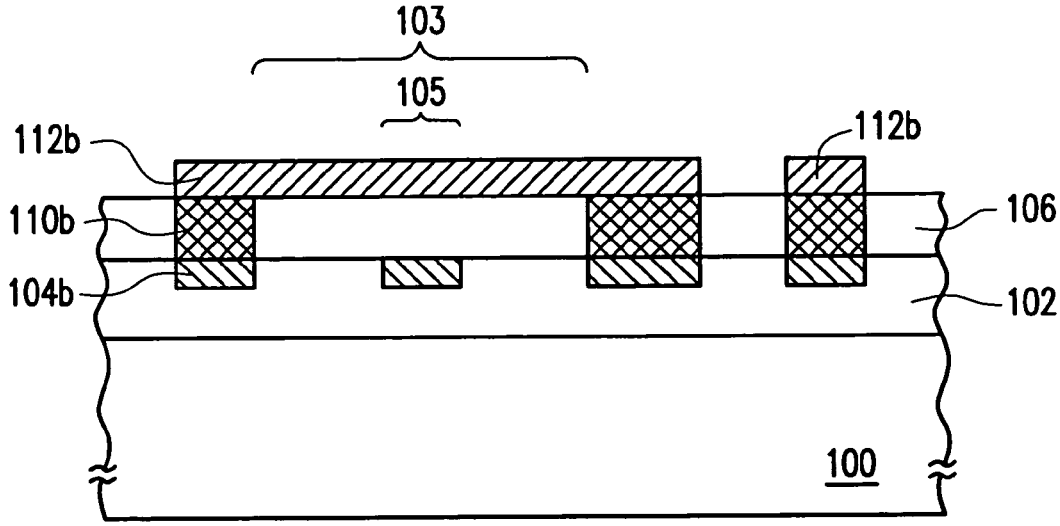

FIG. 1 is a schematic top view showing a first exemplary inductor of the present invention. FIGS. 2A–2C are schematic cross-sectional views showing the structure along I–I' of FIG. 1. FIGS. 3A–3C are schematic cross-sectional views showing the structure along II–II' of FIG. 1. Areas 101, 103 and 105 shown in FIG. 1 correspond to those shown in FIGS. 2A–2C and FIGS. 3A–3C. In the embodiment, it is a symmetric circular-spiral inductor having an overlapping area.

Referring to FIGS. 1, 2A and 3A, the method of fabricating the inductor comprises first providing a substrate 100 having at least dielectric layer 102 thereon, which can be, for example, silicon oxide, silicon nitride or low-k material and can be formed, for example, by depositing the dielectric layer 102 on the substrate 100 and planarizing the dielectric layer 102 by chemical mechanical polishing (CMP). One of ordinary skill in the art will know that the dielectric layer 102 can be a multi-layer structure and that a plurality of devices and interconnects can be formed within the dielectric layer 102 and on the substrate 100.

Figure 4A:
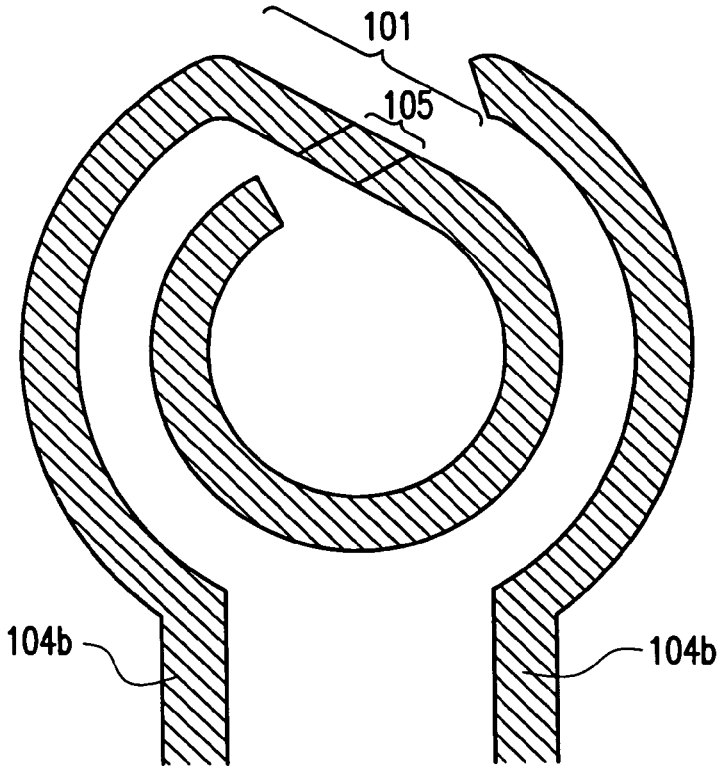
FIGS. 4A–4C are schematic top views showing the inductor patterns of FIG. 1.

A patterned metal layer 104*a* and an inductor pattern 104*b* are then formed within the dielectric layer 102, wherein the top view of the inductor pattern 104*b* is shown as FIG. 4A. The metal layer 104*a* is, for example, the upmost metal layer of the multi-layer interconnect structure on the substrate 100. It means that the inductor pattern 104*b* and the interconnect structure can be formed together during the same process.

Additionally, the material of the patterned metal layer 104*a* and an inductor pattern 104*b* is, for example, copper and formed, for example, by a damascene process. First, openings (not shown) are formed within the dielectric layer 102. Metal is then filled therein for forming the patterned metal layer 104*a* and an inductor pattern 104*b*.

Referring to FIGS. 1, 2B and 3B, a patterned dielectric layer 106 is formed on the dielectric layer 102 for covering the metal layer 104*a*, the inductor pattern 104*b* and the dielectric layer 102. In addition, the dielectric layer 106 has pluralities openings 108*a* and 108*b*, wherein the openings 108*a* expose the metal layer 104*a* and the openings 108*b* expose the inductor pattern 104*b*.

Additionally, the method of forming the dielectric 106 is, for example, by forming a dielectric layer (not shown) for covering the metal layer 104*a*, the inductor pattern 104*b* and the dielectric layer 102. Then, the dielectric layer 106 is planarized by CMP. The pattern of the dielectric layer is defined by lithography and etching processes for forming the openings 108*a* and 108*b* therein.

It should be noted that in order to avoid shortage of the inductor, openings 108*b* are not formed in areas 101 and 103 when they are formed within the dielectric layer 106. It means that the top inductor pattern (not shown) does not contact the inductor pattern 104*b* in areas 101 and 103 through the middle inductor pattern (not shown). Except of the areas 101 and 103, the contour of the openings 108*b* is similar to the inductor pattern 104*b*.

Referring to FIGS. 1, 2B and 3B, metal is filled in the openings 108*a* and 108*b* for forming a metal layer 110*a* within the openings 108*a* and an inductor pattern 110*b* within the openings 108*b*, wherein the metal layer 110*a* serves, for example, as metal plugs and electrically connects with the metal layer 104*a*.

In addition, the method of forming the inductor pattern 110*b* and the metal layer 110*a* is, for example, by forming a metal layer (not shown), which is, for example, tungsten and formed, for example, by low-pressure chemical vapor deposition (LPCVD) or sputtering. Then, planarization is performed for removing portions of metal outside the openings 108*a* and 108*b*. The metal layer 110*a* and the inductor pattern 110*b* therefore are formed. Accordingly, the metal layer 110*a* and the inductor pattern 110*b* are formed in the same process.

Figure 4B:
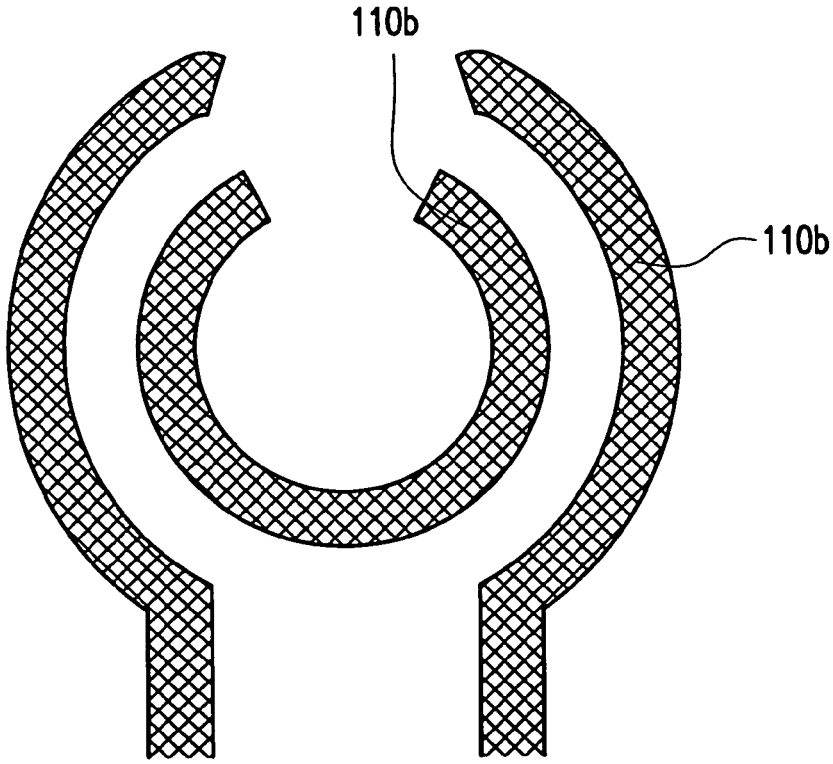

Moreover, the inductor 110*b* shown in FIG. 4B electrically connects with the inductor pattern 104*b*. In order to avoid the shortage of the inductor, the inductor pattern 110*b* are not formed in areas 101, 103 and 105 and the except inductor pattern 110*b* is similar to the inductor pattern 104*b*.

Referring to FIGS. 1, 2C and 3C, a patterned metal layer 112*a* is formed on the metal layer 110*a* and an inductor pattern 112*b* is formed on the inductor pattern 110*b*, wherein the metal layer 112*a* serves, for example, as metal pads and electrically connects with the metal layer 110*a*.

In addition, the metal layer 112*a* and the inductor pattern 112*b* are, for example, aluminum. The method is, for example, by forming a metal layer (not shown) on the dielectric layer 106, which is, for example, formed, by physical vapor deposition (PVD). Then, lithography and etching processes are performed for forming the metal layer 112*a* and the inductor pattern 112*b*. Accordingly, the metal layer 112*a* and the inductor pattern 112*b* therefore are formed in the same process.

Figure 4C:
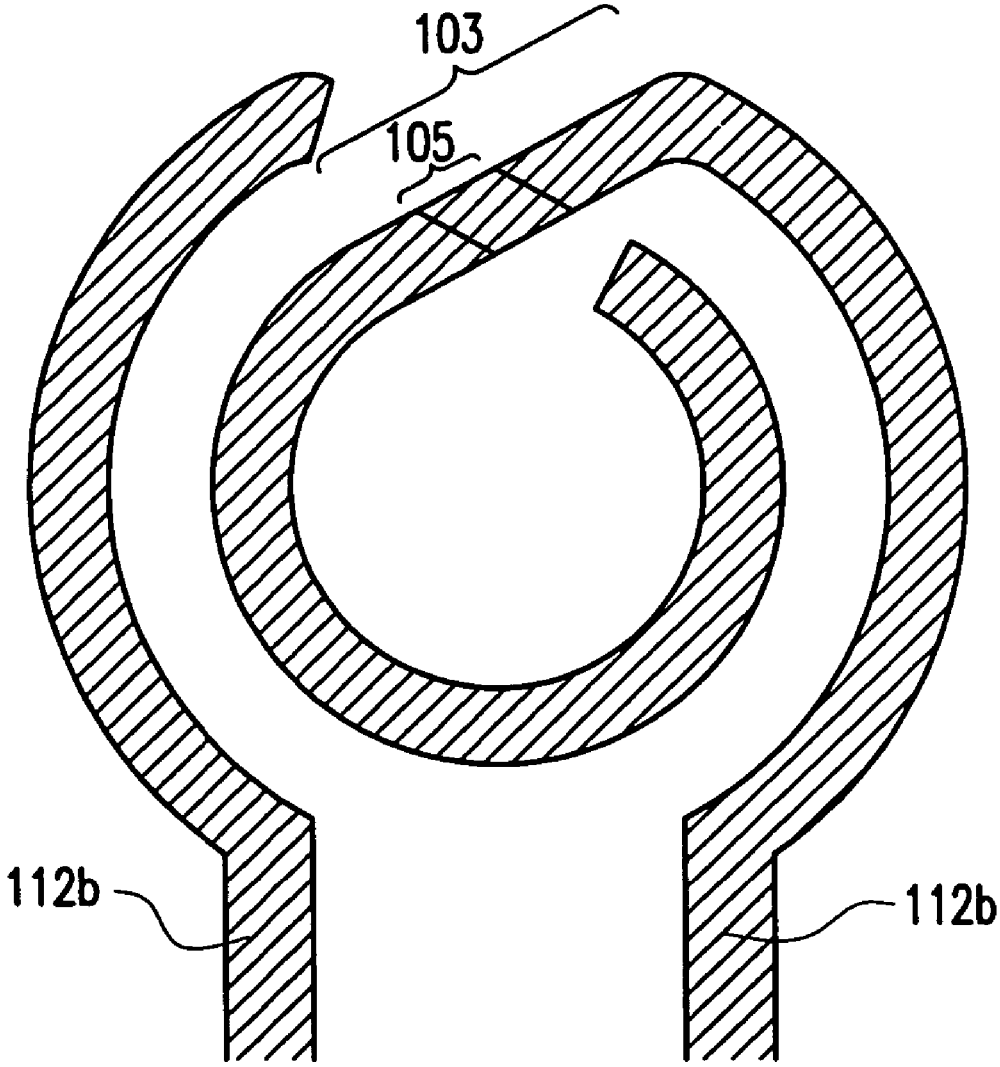

Moreover, the inductor 112*b* shown in FIG. 4C electrically connects with the inductor pattern 110*b*. In order to avoid the shortage of the inductor, the inductor pattern 112*b* are only formed at areas 103 and 105 and the except inductor patterns 112*b*, 110*b* and 104*b* have similar pattern.

It should be noted that the inductor patterns 112*b*, 110*b* and 104*b* constitute a three-dimensional inductor structure as shown in FIG. 1 and forms an overlapping area 105. The inductor pattern 104*b* does not connect with the inductor pattern 112*b* via the inductor pattern 110*b* at the overlapping area 105. By the layout of the overlapping of the three-dimensional inductor structure, a current only flows along the first inductor pattern when the current first time flows through the overlapping area and the current only flows along the third inductor pattern when the current second time flows through the overlapping area. The shortage of the inductor at the overlapping area can be avoided.

Additionally, the present invention is not limited to steps described above. The metal layers 110*a* and 112*a* and the inductor patterns 110*b* and 112*b* can be formed by dual-damascene process.

From the method described above, the present invention uses a multi-layer inductor pattern structure to increase the thickness of the metal wire, to reduce the resistance of the inductor, to enhance the quality factor and to improve the quality of the inductor. Moreover, no extra process is required in the present invention.

In the method of the present invention, the openings 108*b* of the inductor pattern 110*b* can be formed with the openings 108*a* simultaneously. Because the openings 108*a* and 108*b* are at the top layer of the interconnect structure, the process restriction is reduced and the openings 108*b* is similar to the inductor 104*b*.

Following are the descriptions of the inductor formed from the method described above. Referring to FIGS. 1, 2C and 3C, wherein FIG. 1 is a schematic top view showing a first exemplary inductor of the present invention, FIG. 2C is a schematic cross-sectional view showing the structure along I–I' of FIG. 1 and FIG. 3C is a schematic cross-sectional view showing the structure along II–II' of FIG. 1. Areas 101, 103 and 105 shown in FIG. 1 correspond to those shown in FIGS. 2C and 3C. Area 105 represents the overlapping of the areas 101 and 103.

The inductor of the present invention is formed on a substrate 100 having at least one dielectric layer 102 thereon. The inductor comprises three inductor patterns 104*b*, 110*b* and 112*b*.

The inductor pattern 104*b* is formed on the dielectric layer 102 as shown in FIG. 4A. The metal layer 104*a* is also formed therein. It means that the inductor pattern 104*b* and the metal layer 104*a* are formed within the same dielectric layer. The metal layer 104*a* is, for example, the upmost metal layer of the multi-layer interconnect structure on the substrate 100. The material of the inductor pattern 104*b* and the metal layer 104*a* are, for example, copper. It should be noted that the inductor pattern 104*b* is only formed at the overlapping area 105 of the areas 101 and 103.

The inductor pattern 110*b* is formed on the pattern inductor 104*b* as shown in FIG. 4B. Except of the overlapping area, the inductor patterns 110*b* and 104*b* have similar pattern and electrically connect to each other. The metal layer 110*a* is formed on the metal layer 104*a* which means that the metal layer 110*a* and the inductor pattern 110*b* are formed within the same layer. The metal layer 110*a* is, for example, metal plugs. The material of the metal layer 110*a* and the inductor pattern 110*b* are, for example, tungsten. It should be noted that the inductor pattern 110*b* is not formed at the areas 101 and 103 including the area 105.

In addition, the inductor pattern 112*b* is formed on the pattern inductor 110*b* as shown in FIG. 4C. Except of the overlapping area, the inductor patterns 112*b*, 110*b* and 104*b* have similar pattern and the inductor patterns 112*b* and 110*b* electrically connect to each other. The metal layer 112*a* is formed on the metal layer 110*a* which means that the metal layer 112*a* and the inductor pattern 112*b* are formed within the same layer. The metal layer 112*a* is, for example, metal pads. It should be noted that the inductor pattern 112*b* is only formed at the overlapping are 105 of the areas 101 and 103.

Additionally, the inductor patterns 104*b*, 110*b* and 112*b* constitute a three-dimensional inductor structure as shown in FIG. 1. The overlapping area 105 of the three-dimensional inductor structure is composed of the inductor patterns 104*b*, 110*b* and 112*b*. The inductor pattern 104*b* does not connect with the inductor pattern 112*b* via the inductor pattern 110*b* at the overlapping area 105. The shortage of the inductor at the overlapping area can be avoided.

Figure 5:
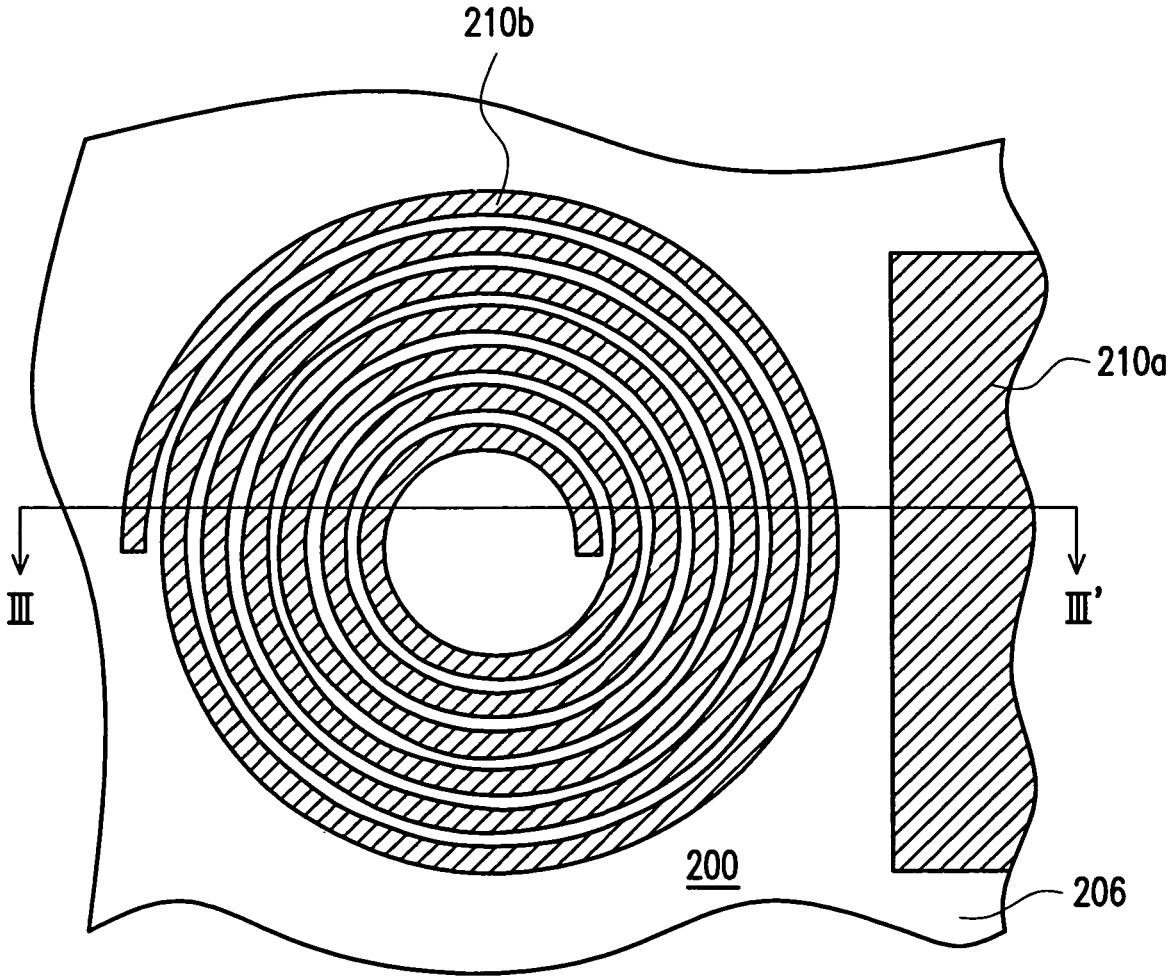
FIG. 5 is a schematic top view showing a second exemplary inductor of the present invention.
Figure 6A:
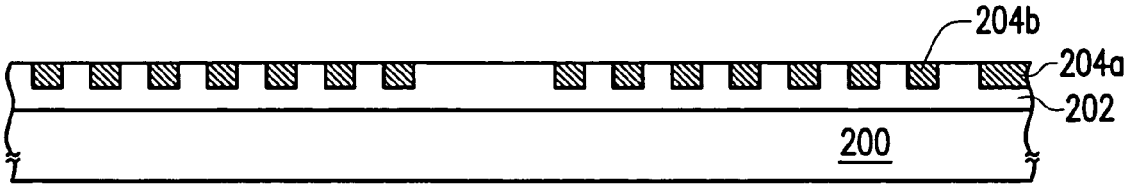
FIGS. 6A–6C are schematic cross-sectional views showing the structure along III–III' of FIG. 5.
Figure 6B:
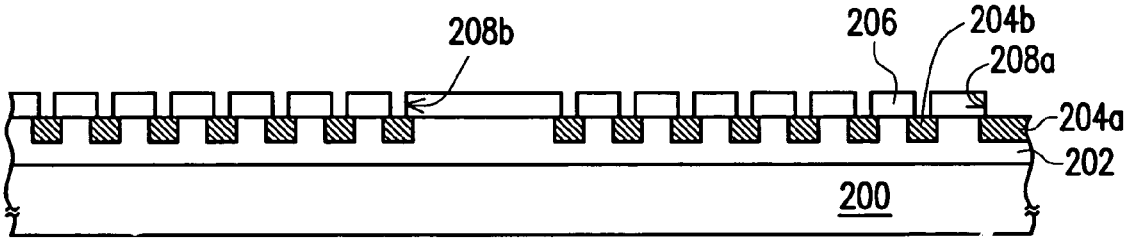
Figure 6C:
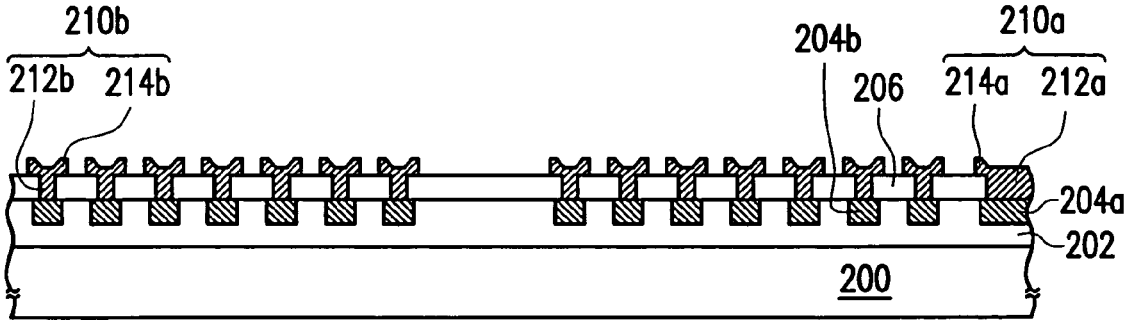

FIG. 5 is a schematic top view showing a second exemplary inductor of the present invention. FIGS. 6A–6C are schematic cross-sectional views showing the structure along III–III' of FIG. 5. In the embodiment, it is a concentric circular-spiral inductor.

Referring to FIGS. 5 and 6A, the method of fabricating the inductor comprises first providing a substrate 200 having at least dielectric layer 202 thereon, which can be, for example, silicon oxide, silicon nitride or low-k material and can be formed, for example, by depositing the dielectric layer 202 on the substrate 200 and planarizing the dielectric layer 202 by chemical mechanical polishing (CMP). One of ordinary skill in the art will know that the dielectric layer 202 can be a multi-layer structure and that a plurality of devices and interconnects can be formed within the dielectric layer 202 and on the substrate 200.

Figure 7A:
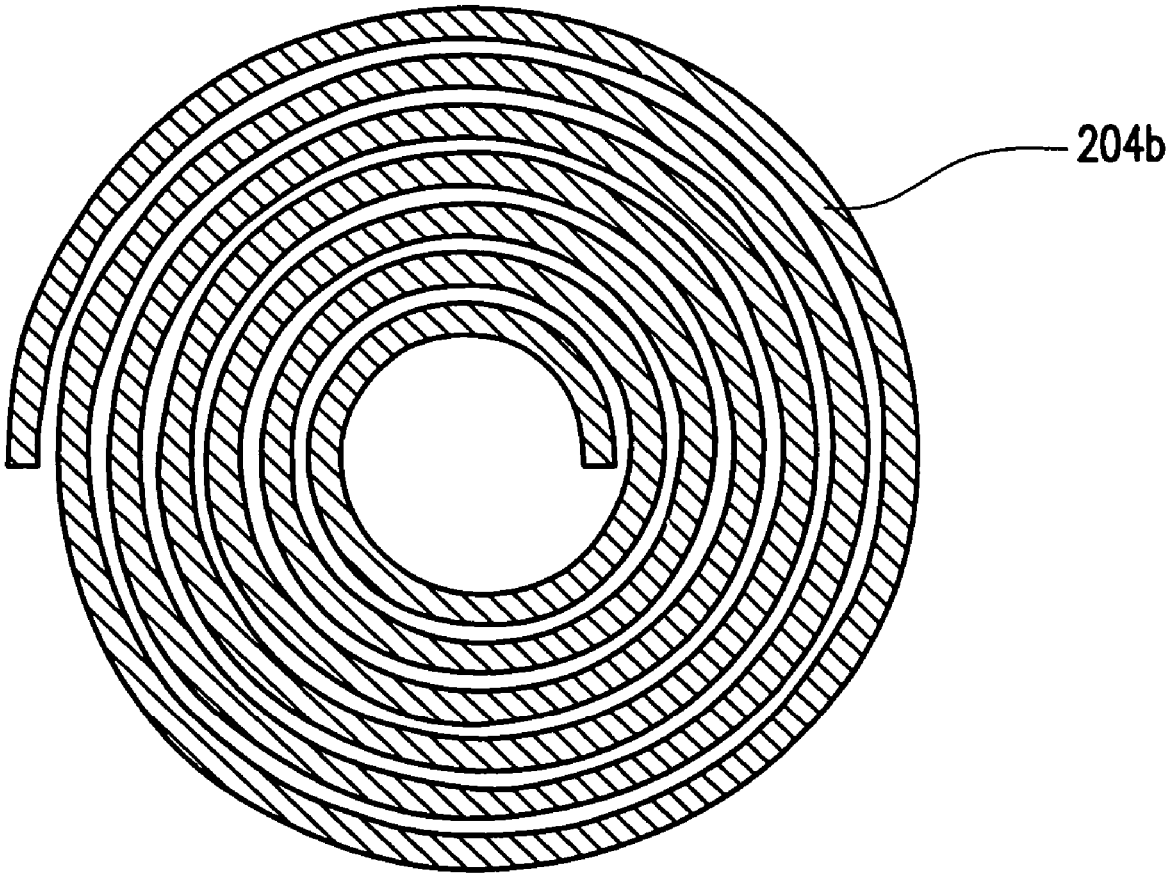
FIGS. 7A–7C are schematic top views showing the inductor patterns of FIG. 5.

A patterned metal layer 204*a* and an inductor pattern 204*b* are then formed within the dielectric layer 202, wherein the top view of the inductor pattern 204*b* is shown as FIG. 7A. The metal layer 204*a* is, for example, the upmost metal layer of the multi-layer interconnect structure on the substrate 200. It means that the inductor pattern 204*b* and the interconnect structure can be formed together during the same process.

Additionally, the material of the patterned metal layer 204*a* and an inductor pattern 204*b* is, for example, copper and formed, for example, by a damascene process. First, openings (not shown) are formed within the dielectric layer 202. Metal is then filled therein for forming the patterned metal layer 204*a* and an inductor pattern 204*b*.

Referring to FIGS. 5 and 6B, a patterned dielectric layer 206 is formed on the dielectric layer 202 for covering the metal layer 204*a*, the inductor pattern 204*b* and the dielectric layer 202. In addition, the dielectric layer 206 has pluralities openings 208*a* and 208*b*, wherein the openings 208*a* expose the metal layer 204*a* and the openings 208*b* expose the inductor pattern 204*b*. The contour of the openings 208*b* is similar to the inductor pattern 204*b*, which means the openings 208*b* are formed along the inductor pattern 204*b*.

Additionally, the method of forming the dielectric 206 is, for example, by forming a dielectric layer (not shown) for covering the metal layer 204, the inductor pattern 104*b* and the dielectric layer 202. Then, the dielectric layer 206 is planarized by CMP. The pattern of the dielectric layer is defined by lithography and etching processes for forming the openings 208*a* and 208*b* therein.

Referring to FIGS. 5 and 6C, the metal layer 210*a* of the openings 208*a* and 208*b* and an inductor pattern 210*b* are formed within the dielectric layer 206, wherein the metal layer 110*a* electrically connects with the metal layer 204*a* which can be deemed being composed of the metal layer 212*a* and the metal layer 214*a*. The metal layer 212*a* of the openings 208*a* serves, for example, as metal plugs and the metal layer 214*a* on the dielectric layer 206 serves, for example, as metal pads.

The inductor pattern can be deemed as a single inductor pattern or be composed of the inductor pattern 212*b* of the openings 208*b* and the inductor pattern 214*b* on the dielectric layer 206 as described in first embodiment. Because the openings 208*b* has similar pattern as that of the inductor pattern 204*b*, the inductor patterns 212*b*, 214*b* and 204*b* have similar pattern.

In addition, the metal layer 210*a* and the inductor pattern 210*b* are, for example, aluminum. The method is, for example, by forming a metal layer (not shown) on the dielectric layer 206, which is, for example, formed, by physical vapor deposition (PVD). Then, lithography and etching processes are performed for forming the metal layer 210*a* (212*a* and 214*a*) and the inductor pattern 210*b* (212*b* and 214*b*). Accordingly, the metal layer 210*a* and the inductor pattern 210*b* therefore are formed in the same process.

Similarly, the present invention uses a multi-layer inductor pattern structure to increase the thickness of the metal wire, to reduce the resistance of the inductor, to enhance the quality factor and to improve the quality of the inductor. Moreover, no extra process is required in the present invention.

In the method of the present invention, the openings 208*b* of the inductor pattern 210*b* can be formed with the openings 208*a* simultaneously. Because the openings 208*a* and 208*b* are at the top layer of the interconnect structure, the process restriction is reduced and the openings 208*b* and the inductor 204*b* have similar pattern.

Moreover, in the embodiment the metal layers 212*a* and 214*a* and the inductor patterns 212*b* and 214*b* can be formed during the same deposition, lithography and etching processes; therefore, this embodiment is more simplified than the first embodiment. In addition, because the inductor patterns 212*b* and 214*b* have the same material, the contact resistance thereof is reduced and quality factor is enhanced. Moreover, the inductor pattern 212*b* can be aluminum. Compared with tungsten used in the first embodiment, the contact resistance thereof s reduced and quality factor is enhanced.

Following are the descriptions of the inductor formed from the method described above. Referring to FIGS. 5 and 6C, wherein FIG. 5 is a schematic top view showing a first exemplary inductor of the present invention and FIG. 6C is a schematic cross-sectional view showing the structure along III–III' of FIG. 5.

The inductor of the present invention is formed on a substrate 200 having at least one dielectric layer 202 thereon. The inductor comprises three inductor patterns 204*b* and 210*b*.

The inductor pattern 204*b* is formed on the dielectric layer 202 as shown in FIG. 7A. The metal layer 204*a* is also formed therein. It means that the inductor pattern 204*b* and the metal layer 204*a* are formed within the same dielectric layer. The metal layer 204*a* is, for example, the upmost metal layer of the multi-layer interconnect structure on the substrate 200. The material of the inductor pattern 204*b* and the metal layer 204*a* are, for example, copper.

Figure 7B:
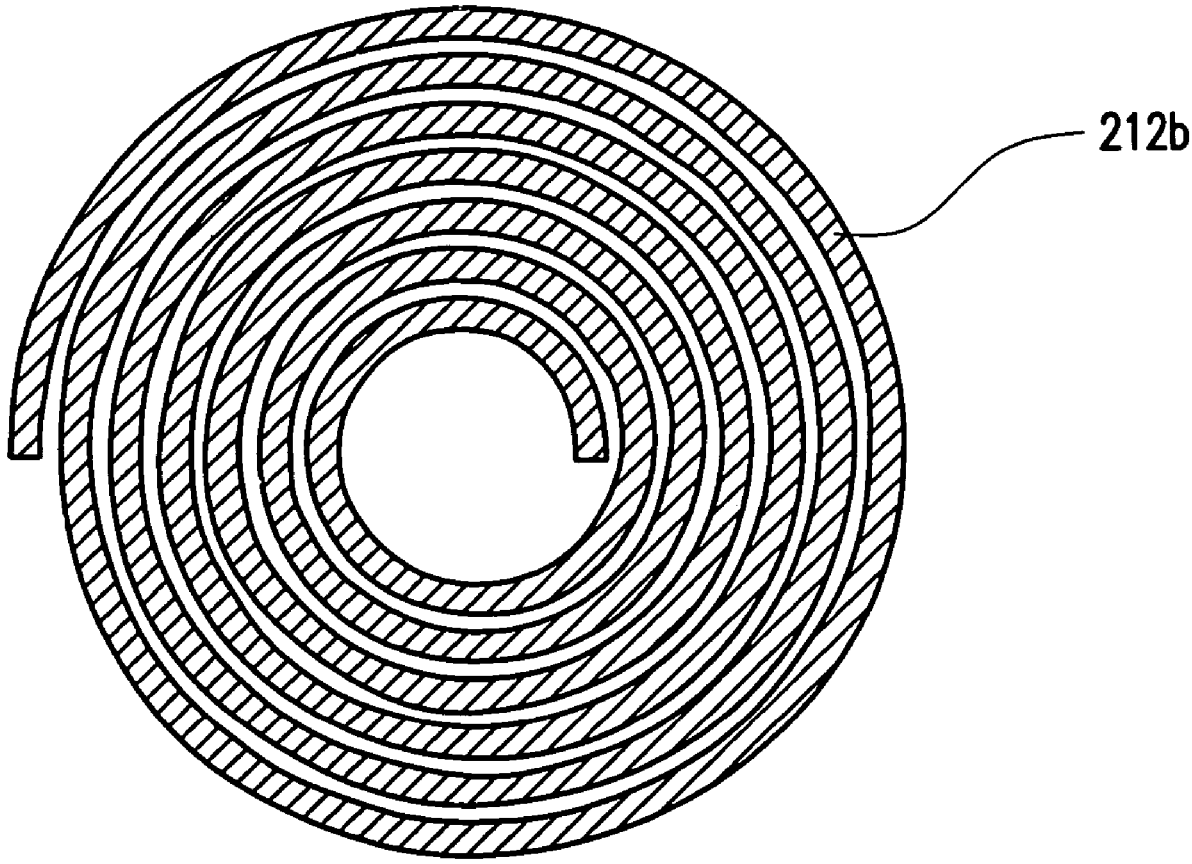
Figure 7C:
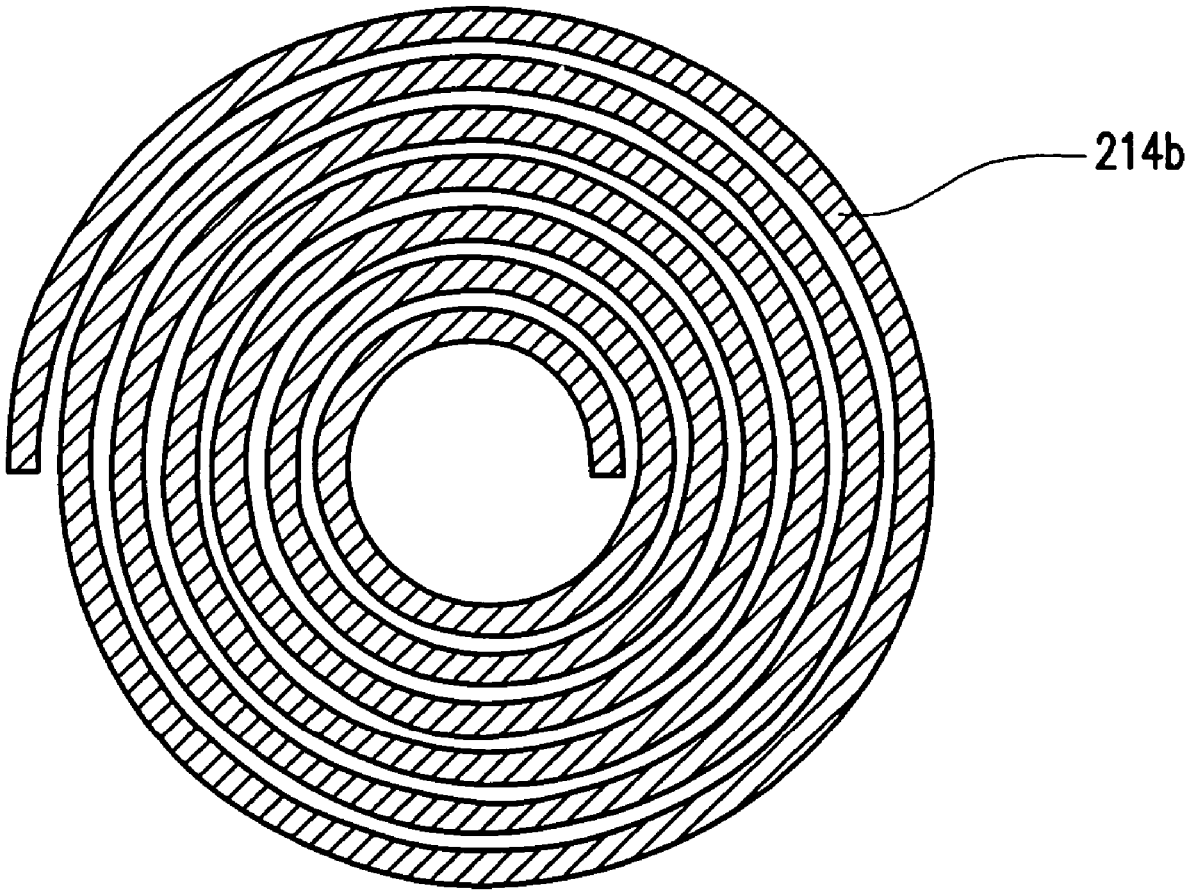

In addition, the inductor pattern 210*b* is formed on the pattern inductor 204*b* as shown in FIG. 7C. The inductor patterns 210*b* and 204*b* connect to each other. Additionally, the metal layer 210*a* is formed on the metal layer 204*a* which is formed within the same layer of the inductor pattern 210*b*. In the embodiment, the inductor pattern 210*b* can be deemed being composed of the inductor patterns 212*b* shown in FIG. 7B and 214*b* shown in FIG. 7C. Similarly, the metal layer 212*a* can be deemed as being composed of the metal layers 212*a* and 214*a*. The metal layer 212*a* of the openings 208*a* serves, for example, as metal plugs and the metal layer 214*a* on the dielectric layer 206 serves, for example, as metal pads. The material of the metal layer 210*a* and inductor pattern 210*b* can be, for example, aluminum.

Of course, the layout of the inductor is not limited to the symmetric circular-spiral type shown in FIG. 1 or concentric circular-spiral type shown in FIG. 5. The other type inductor, such as a symmetric rectangular-spiral type or a concentric rectangular-spiral type, can also be applied to the present invention.

Moreover, in the symmetric circular-spiral inductor of the first embodiment the first, second and third inductor patterns are formed by different deposition processes. However, the present invention is not limited thereto. In the inductor of the first embodiment, the second and third inductor patterns can be formed during the same deposition, lithography and etching processes as those of the second embodiment. In other words, any type of inductor can be formed by the method of the first embodiment or the second embodiment.

Accordingly, the present invention uses a multi-layer inductor pattern structure to increase the thickness of the metal wire, to reduce the resistance of the inductor, to enhance the quality factor and to improve the quality of the inductor.

Moreover, each layer of the multi-layer inductor structure of the present invention has similar pattern for forming a uniform thickness thereof and enhancing the quality factor.

Furthermore, the inductor and the metals pads can be formed together, which is more distant from the substrate than the prior art inductor; therefore, the interference resulting from the substrate to the inductor can be reduced and the chip performance is improved.

Moreover, the process is simplified because the metal plugs and metal pads are formed by the same deposition, lithography and etching processes.

Furthermore, because the inductors with respect to the metal plugs and metal pads have the same material, the contact resistance resulting from application of different materials can be avoided and the quality factor of the inductor is improved.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A method of fabricating an inductor formed on a substrate having at least one first dielectric layer thereon, the method comprising:

forming a patterned first metal layer and a first inductor pattern within the first dielectric layer;

forming a patterned second dielectric layer on the first dielectric layer for covering the first metal layer, the first inductcor pattern and the first dielectric layer, the second dielectric layer having an opening and a circular-spiral trench, wherein the opening exposes the first metal layer and the circular-spiral trench exposes the first inductor pattern;

filling a metal within the opening and the circular-spiral trench for forming a second metal layer within the opening and a second inductor pattern within the circular-spiral trench, wherein the second metal layer directly contacts with the first metal layer and the second inductor pattern directly contacts with the first inductor pattern; and forming a patterned third metal layer on the second metal layer and a third inductor pattern on the second inductor pattern, wherein the third metal layer directly contacts with the second metal layer, the third inductor pattern directly contacts with the second inductor pattern, and the first inductor pattern and the third inductor pattern are not completely overlapping, only flowing along the third inductor pattern when the current second time flows through the area.

2. The method of fabricating an inductor of claim 1, wherein the first metal layer comprises the upmost metal layer of a multi-layer interconnect on the substrate.

3. The method of fabricating an inductor of claim 1, wherein the second metal layer comprises metal plugs.

4. The method of fabricating an inductor of claim 1, wherein the third metal layer comprises metal pads.

5. The method of fabricating an inductor of claim 1, wherein the inductor comprises a symmetric circular-spiral inductor or a concentric circular-spiral inductor.

6. The method of fabricating an inductor of claim 1, wherein the first inductor pattern, the second inductor pattern and the third inductor pattern constitute a three-dimensional inductor structure; the three-dimensional inductor structure has an area; at the area the first inductor pattern does not connect with the third inductor pattern via the second inductor pattern for making a current only flowing along the first inductor pattern when the current first time flows through the area and the current only flowing along the third inductor pattern when the current second time flows through the area.

7. An inductor formed on a substrate having at least one dielectric layer thereon, comprising:

a first inductor pattern formed within the dielectric layer;

a second inductor pattern formed on the first inductor pattern and directly contacting therewith; and a third inductor pattern formed on the second inductor pattern and directly contacting therewith, wherein the first inductor pattern and the third inductor pattern are not completely overlapping.

8. The inductor of claim 7, wherein the first inductor pattern and a patterned first metal layer formed on the substrate are on the same layer and the first metal layer comprises the upmost metal layer of a multi-layer interconnect structure formed on the substrate.

9. The inductor of claim 7, wherein the second inductor pattern and a patterned second metal layer formed on the substrate are on the same layer, and the second metal layer comprises metal plugs.

10. The inductor of claim 7, wherein the third inductor pattern and a patterned third metal layer formed on the substrate are on the same layer, and the third metal layer comprises metal pads.

11. The inductor of claim 7, wherein the inductor comprises symmetric circular-spiral inductor or a concentric circular-spiral inductor.

12. The inductor of claim 7, wherein the first inductor pattern, the second inductor pattern and the third inductor pattern constitute a three-dimensional inductor structure; the three-dimensional inductor structure has an area; at the area the first inductor pattern does not connect with the third inductor pattern via the second inductor pattern for making a current only flowing along the first inductor pattern when the current first time flows through the area and the current only flowing along the third inductor pattern when the current second time flows through the area.

13. A method of fabricating an inductor formed on a substrate having at least one first dielectric layer thereon, comprising:

forming a patterned first metal layer and a first inductor pattern within the first dielectric layer;

forming a patterned second dielectric layer on the first dielectric layer for covering the first metal layer, the first inductor pattern and the first dielectric layer, the second dielectric layer having an opening and a circular-spiral trench, wherein the opening exposes the first metal layer and the circular-spiral trench exposes the first inductor pattern; and forming a second metal layer filling the opening and on the second dielectric layer and forming a second inductor pattern filling the circular-spiral trench and on the second dielectric layer, wherein the second metal layer directly contacts with the first metal layer and the second inductor pattern directly contacts with the first inductor pattern, and the first inductor pattern and the second inductor are not completely overlapping.

14. The method of fabricating an inductor of claim 13, wherein the first metal layer comprises the upmost metal layer of a multi-layer interconnect on the substrate.

15. The method of fabricating an inductor of claim 13, wherein the second metal layer comprises metal plugs and metal pads.

16. The method of fabricating an inductor of claim 15, wherein the second metal layer and the second inductor pattern comprise aluminum.

17. The method of fabricating an inductor of claim 13, wherein the inductor comprises symmetric circular-spiral inductor or a concentric circular-spiral inductor.

18. The method of fabricating an inductor of claim 13, wherein the first inductor pattern and the second inductor pattern constitute a three-dimensional inductor structure; the three-dimensional inductor structure has an area; at the area the first inductor pattern does not connect with the second inductor pattern for making a current only flowing along the first inductor pattern when the current first time flows through the area and the current.

19. The method of fabricating an inductor of claim 1, wherein the patterns of the first inductor pattern, the second inductor pattern and the third inductor pattern are different to each other.

20. The method of fabricating an inductor of claim 19, wherein the bottom surface of the second inductor pattern is completely contacts with the first inductor pattern while the top surface of the second inductor pattern is completely contacts with the third inductor pattern.

21. The inductor of claim 7, wherein the patterns of the first inductor pattern, the second inductor pattern and the third inductor pattern are different to each other.

22. The inductor of claim 21, wherein the bottom surface of the second inductor pattern is completely contacts with the first inductor pattern while the top surface of the second inductor pattern is completely contacts with the third inductor pattern.

23. The method of fabricating an inductor of claim 13, wherein the patterns of the first inductor pattern and the second inductor pattern are different to each other.

* * * * *